US006997482B2

(12) United States Patent
Mathys

(10) Patent No.: US 6,997,482 B2
(45) Date of Patent: Feb. 14, 2006

(54) CONTROL ELEMENT FOR PRINTED MATTERS

(75) Inventor: Laurent Mathys, Plan-Les-Oautes (CH)

(73) Assignee: KBA-Giori S.A., Lausanne (CH)

( * ) Notice: Subject to any disclaimer, the term of this patent is extended or adjusted under 35 U.S.C. 154(b) by 320 days.

(21) Appl. No.: 10/226,946

(22) Filed: Aug. 23, 2002

(65) Prior Publication Data

US 2004/0036272 A1 Feb. 26, 2004

(30) Foreign Application Priority Data

Sep. 7, 2001 (CH) ..... 1661/01

(51) Int. Cl.
*B42D 15/00* (2006.01)

(52) U.S. Cl. ..... 283/72; 283/94; 428/195.1; 428/915; 428/916

(58) Field of Classification Search ..... 283/81, 283/72, 91, 93, 94, 113; 428/40.1, 42.1, 428/195.1, 915, 916
See application file for complete search history.

(56) References Cited

U.S. PATENT DOCUMENTS 5,443,579 A 8/1995 Tanaka et al.
5,772,249 A 6/1998 Guex et al.
6,050,606 A 4/2000 Foresti
6,089,614 A * 7/2000 Howland et al. ..... 283/91
2004/0036272 A1 * 2/2004 Mathys ..... 283/72

FOREIGN PATENT DOCUMENTS

CA 1066109 A 11/1979
EP 0 509 916 A1 10/1992
EP 0 642 933 A 3/1995
EP 0 710 574 A2 5/1996

OTHER PUBLICATIONS

International Search Report in SN CH 16612001.

* cited by examiner

*Primary Examiner*—Monica S. Carter
(74) *Attorney, Agent, or Firm*—Bugnion S.A.; John Moetteli

(57) ABSTRACT

The control element has a first drawing printed on a first side of the article, comprising at least a first set of geometrical shapes. It includes a second drawing printed on a second side of said article, the second drawing being printed so as to face the first drawing and be in register with the latter, said second drawing comprising at least a second set of geometrical shapes corresponding to the first screen. At least one of said geometrical sets includes sectors which are offset so that, when the front side/reverse side register is correct, the control element has regions of variable density which are visible in transmitted light and are created by said offset sectors.

7 Claims, 11 Drawing Sheets

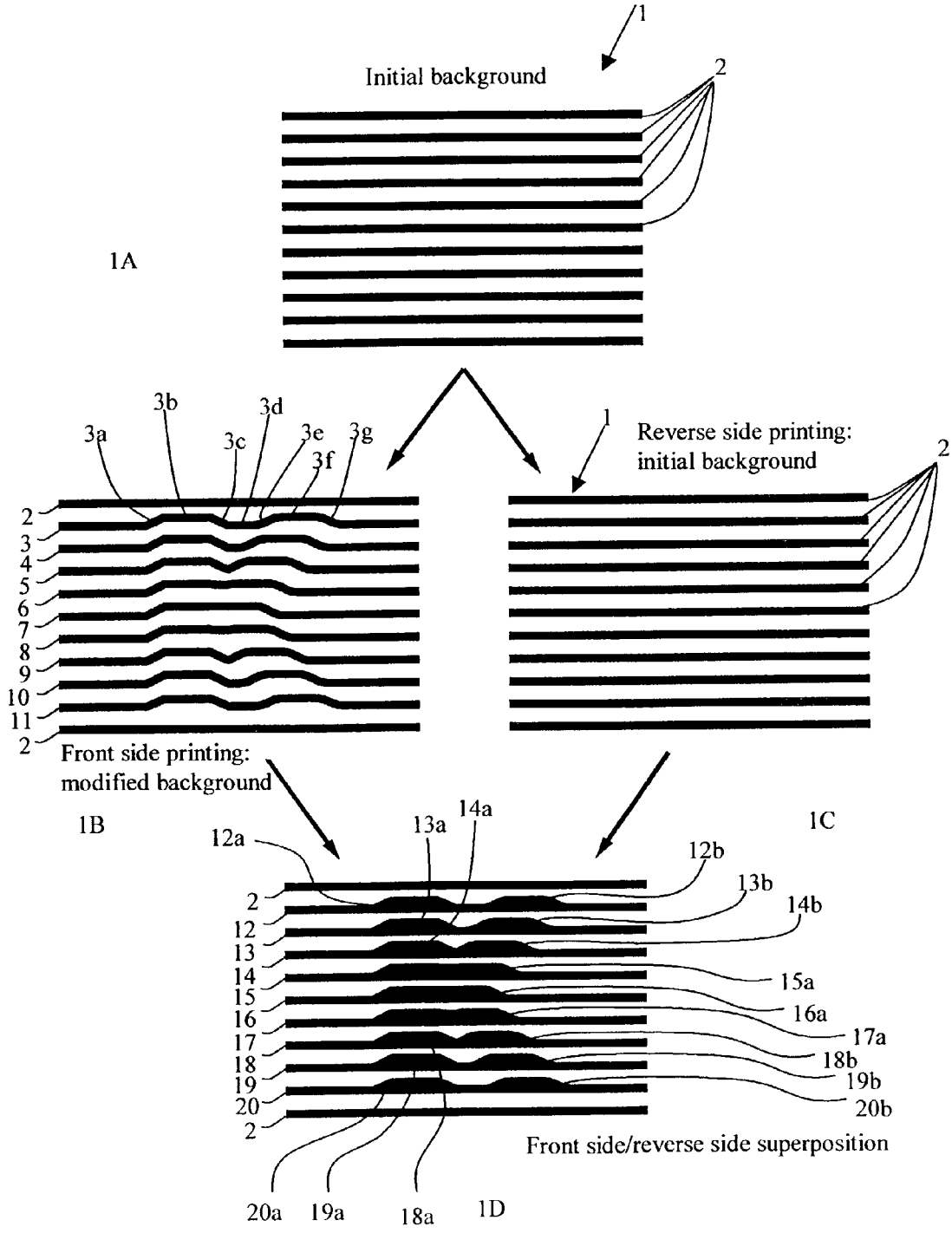
1
Initial background
2
1A
3a
3b
3c
3d
3e
3f
3g
2
3
4
5
6
7
8
9
10
11
2
1
Reverse side printing:
initial background
2
Front side printing:
modified background
1B
1C
12a
13a
14a
12b
13b
14b
2
12
13
14
15
16
17
18
19
20
2
15a
16a
17a
18b
19b
20b
Front side/reverse side superposition
20a
19a
18a
1D

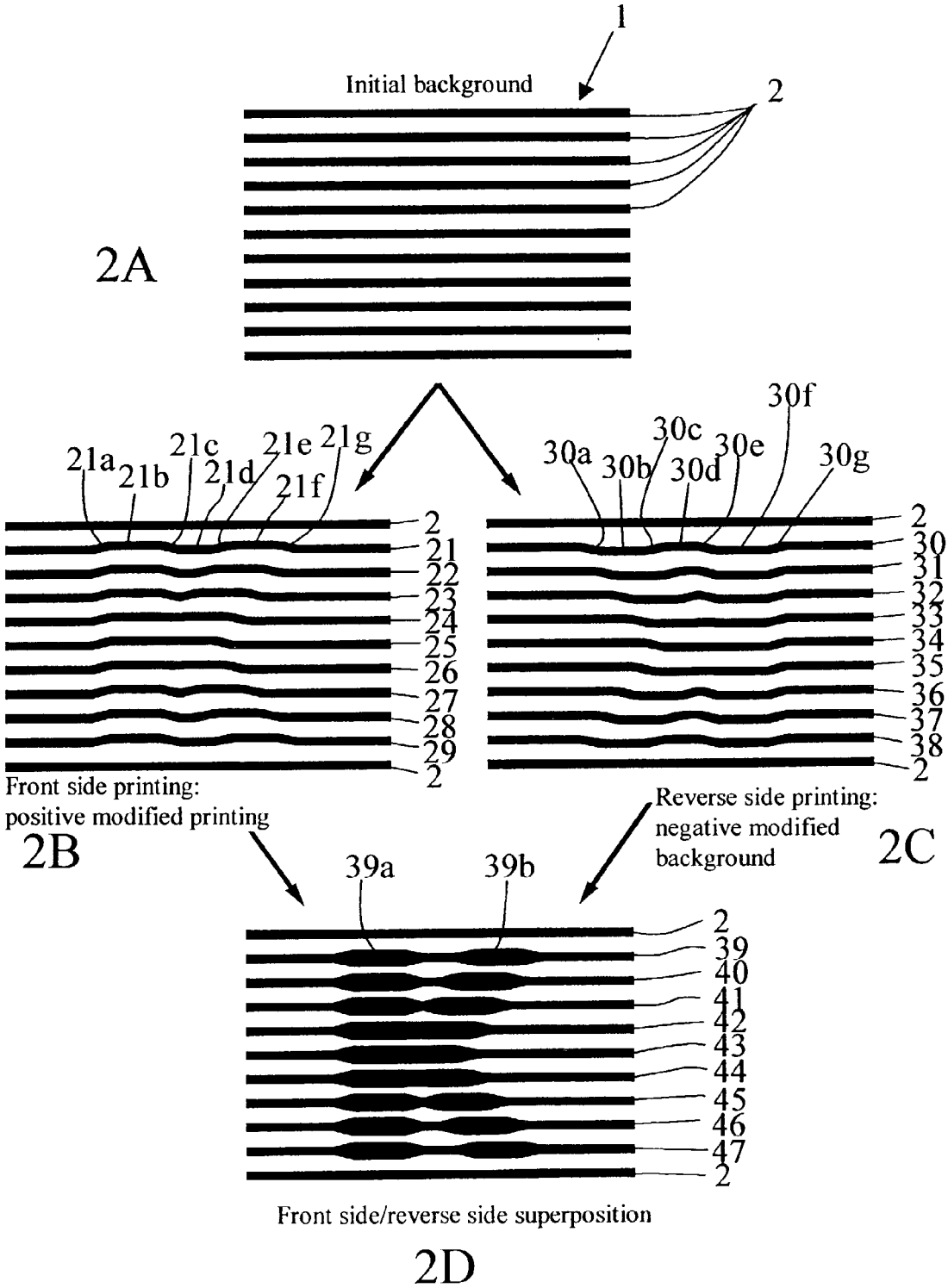
1
Initial background
2
2A
21a
21b
21c
21d
21e
21f
21g
2
21
22
23
24
25
26
27
28
29
2
Front side printing:
positive modified printing
2B
30a
30b
30c
30d
30e
30f
30g
2
30
31
32
33
34
35
36
37
38
2
Reverse side printing:
negative modified
background
2C
39a
39b
2
39
40
41
42
43
44
45
46
47
2
Front side/reverse side superposition
2D

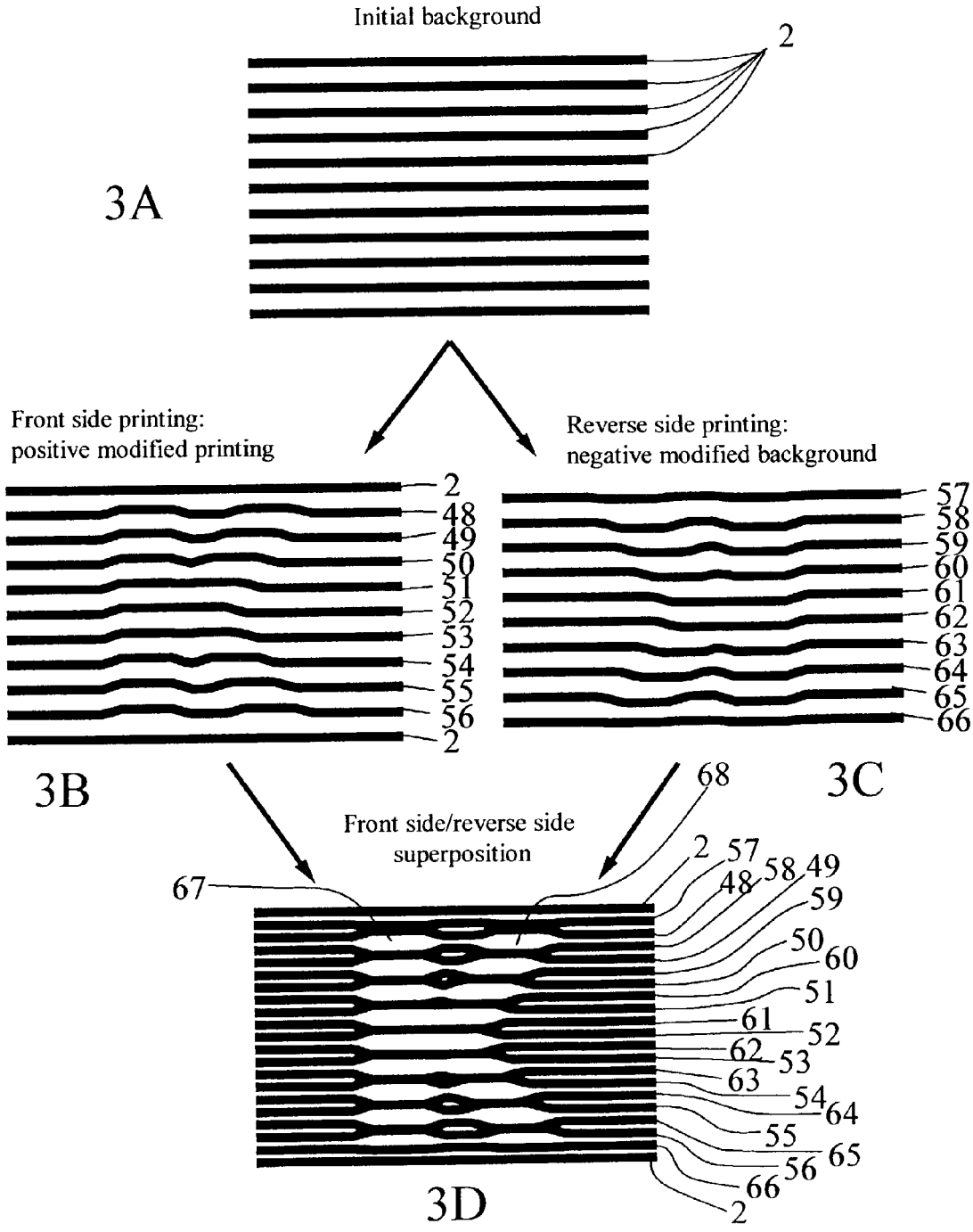
Initial background
2
3A
Front side printing:
positive modified printing
Reverse side printing:
negative modified background
2
48
49
50
51
52
53
54
55
56
2
57
58
59
60
61
62
63
64
65
66
3B
3C
68
Front side/reverse side
superposition
67
2
57
48
58
49
59
50
60
51
61
52
62
53
63
54
64
55
65
56
66
2
3D

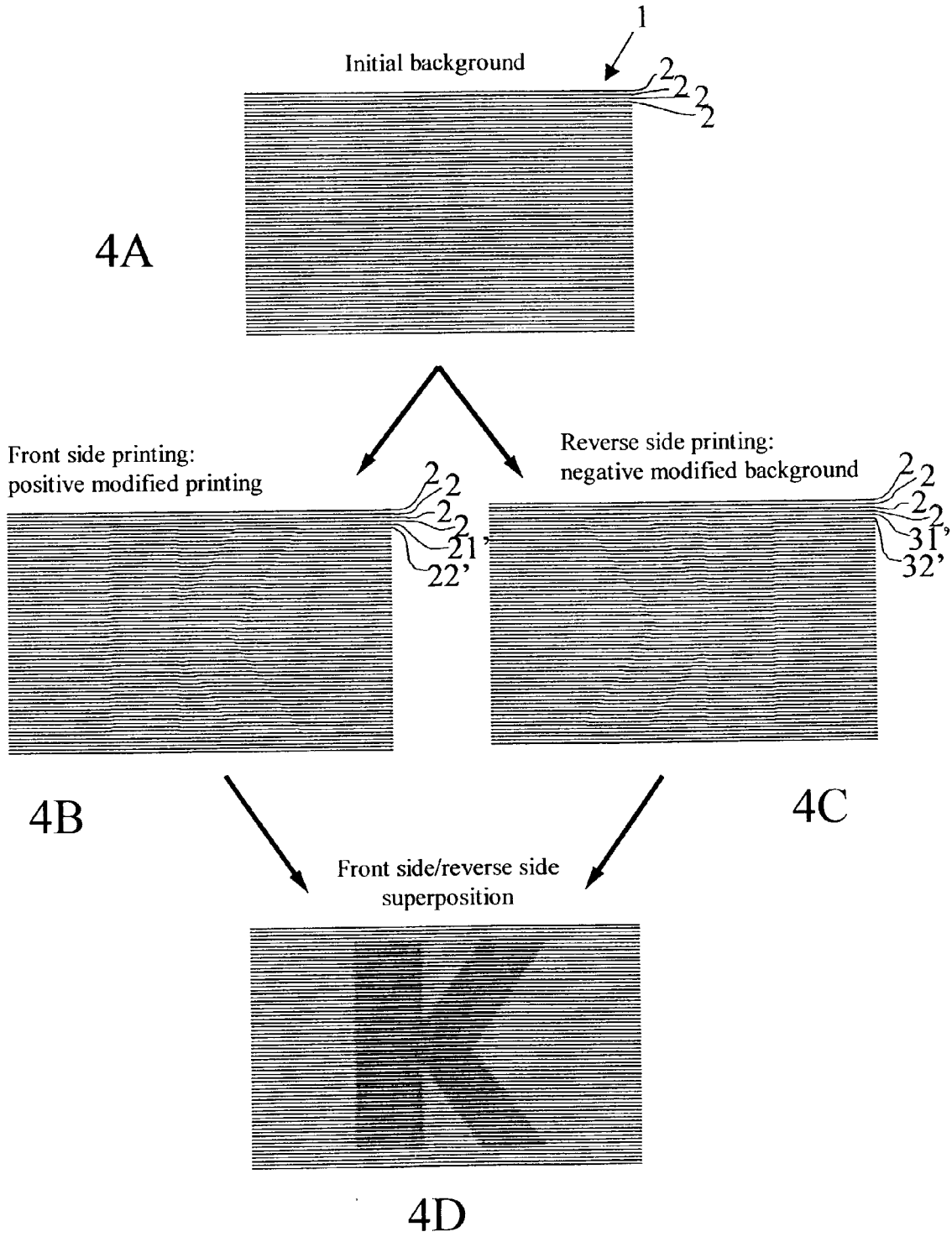
1
Initial background
2
2
2
2
4A
Front side printing:
positive modified printing
2
2
2
2
21'
22'
Reverse side printing:
negative modified background
2
2
2
2
31'
32'
4B
4C
Front side/reverse side
superposition
4D

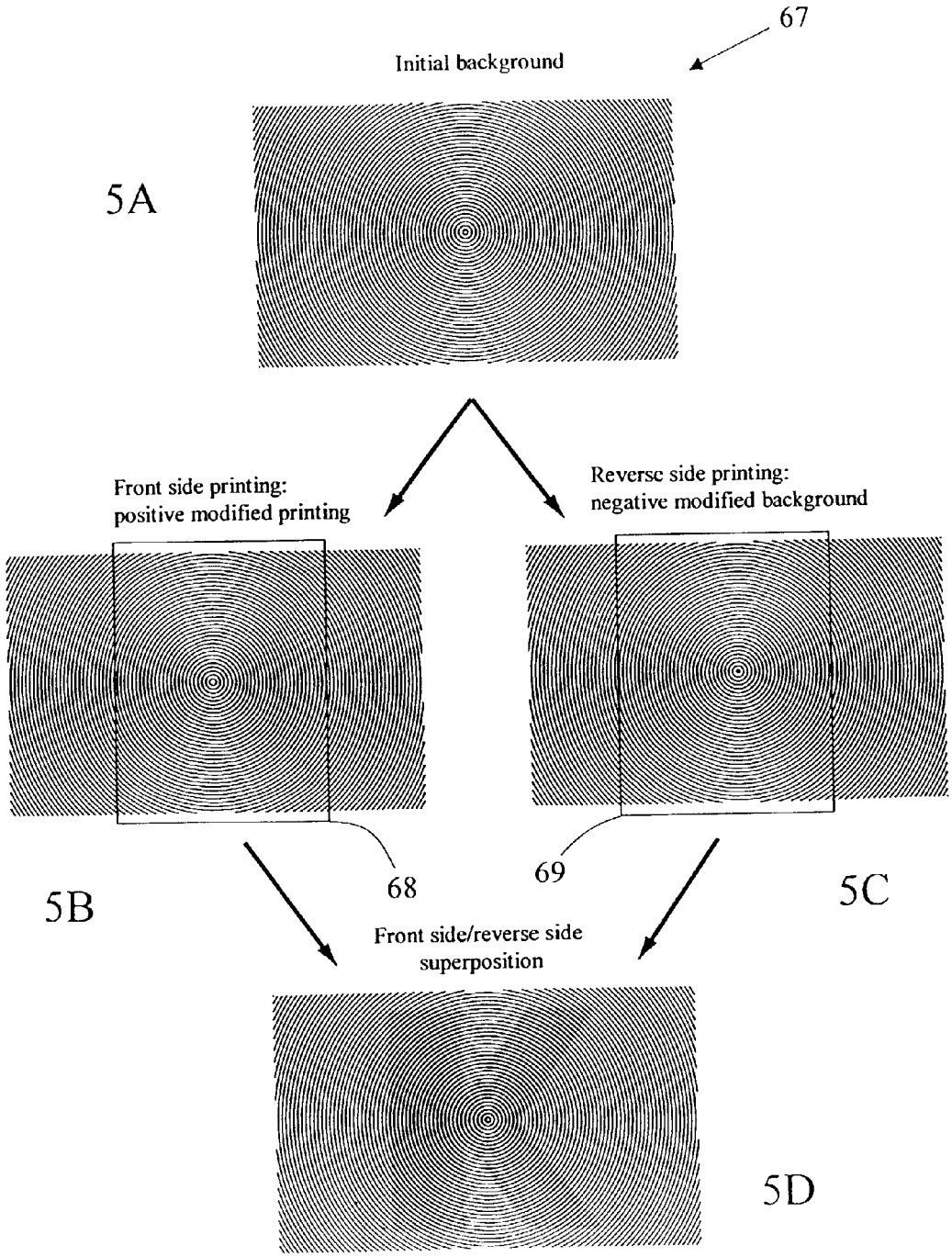
67
Initial background
5A
Front side printing:
positive modified printing
Reverse side printing:
negative modified background
68
69
5B
5C
Front side/reverse side
superposition
5D

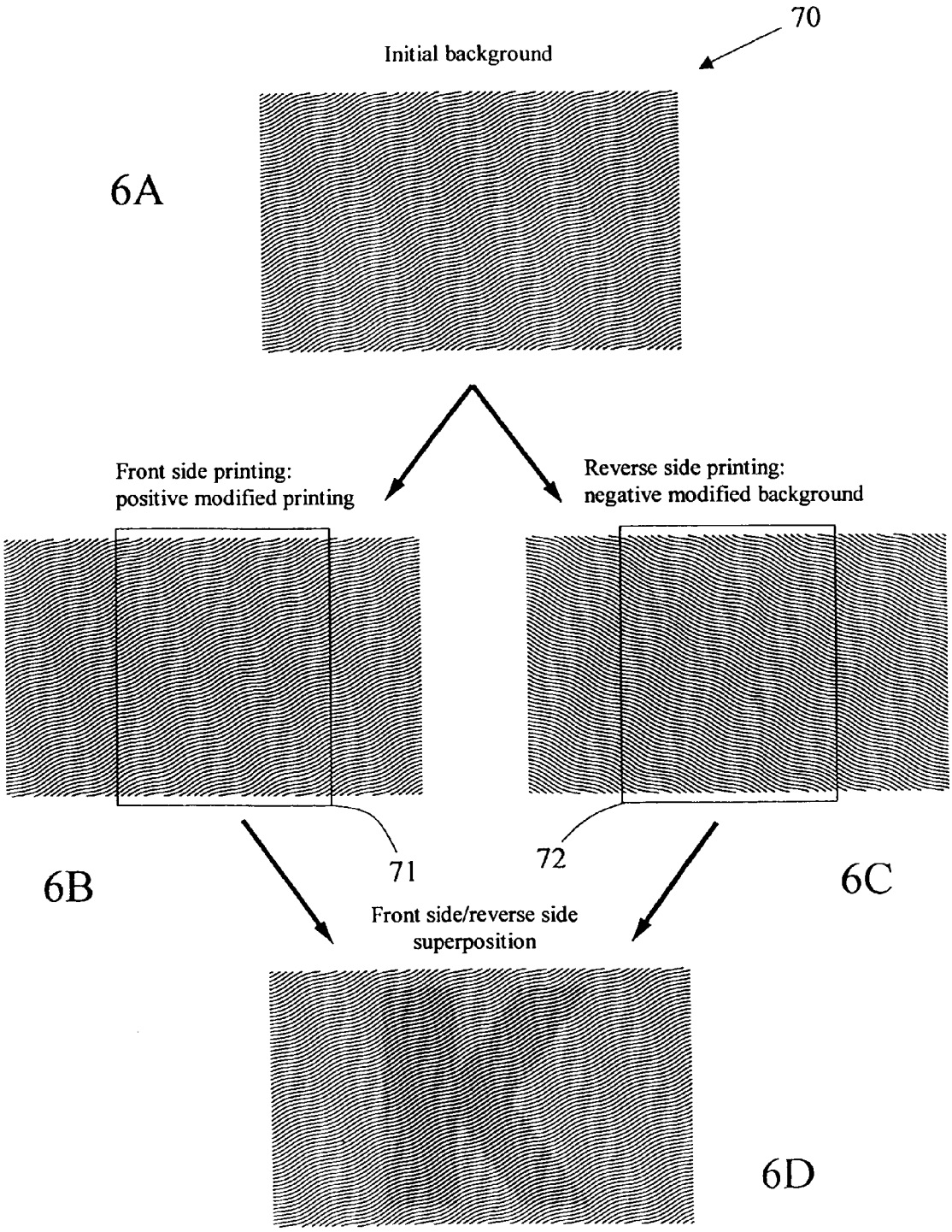
70
Initial background
6A
Front side printing:
positive modified printing
Reverse side printing:
negative modified background
71
72
6B
6C
Front side/reverse side
superposition
6D

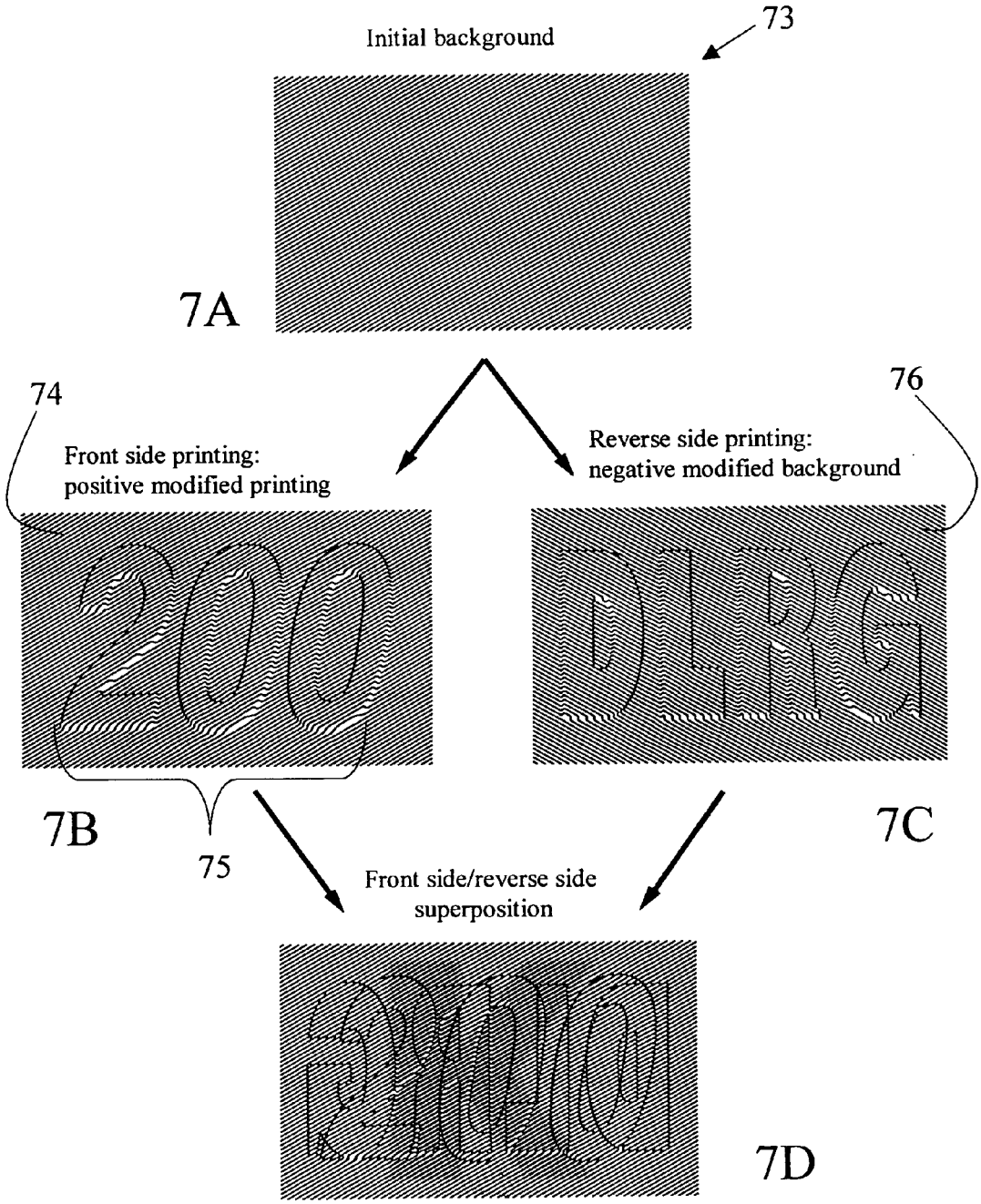
Initial background
73
7A
74
76
Front side printing:
positive modified printing
Reverse side printing:
negative modified background
7B
7C
75
Front side/reverse side
superposition
7D

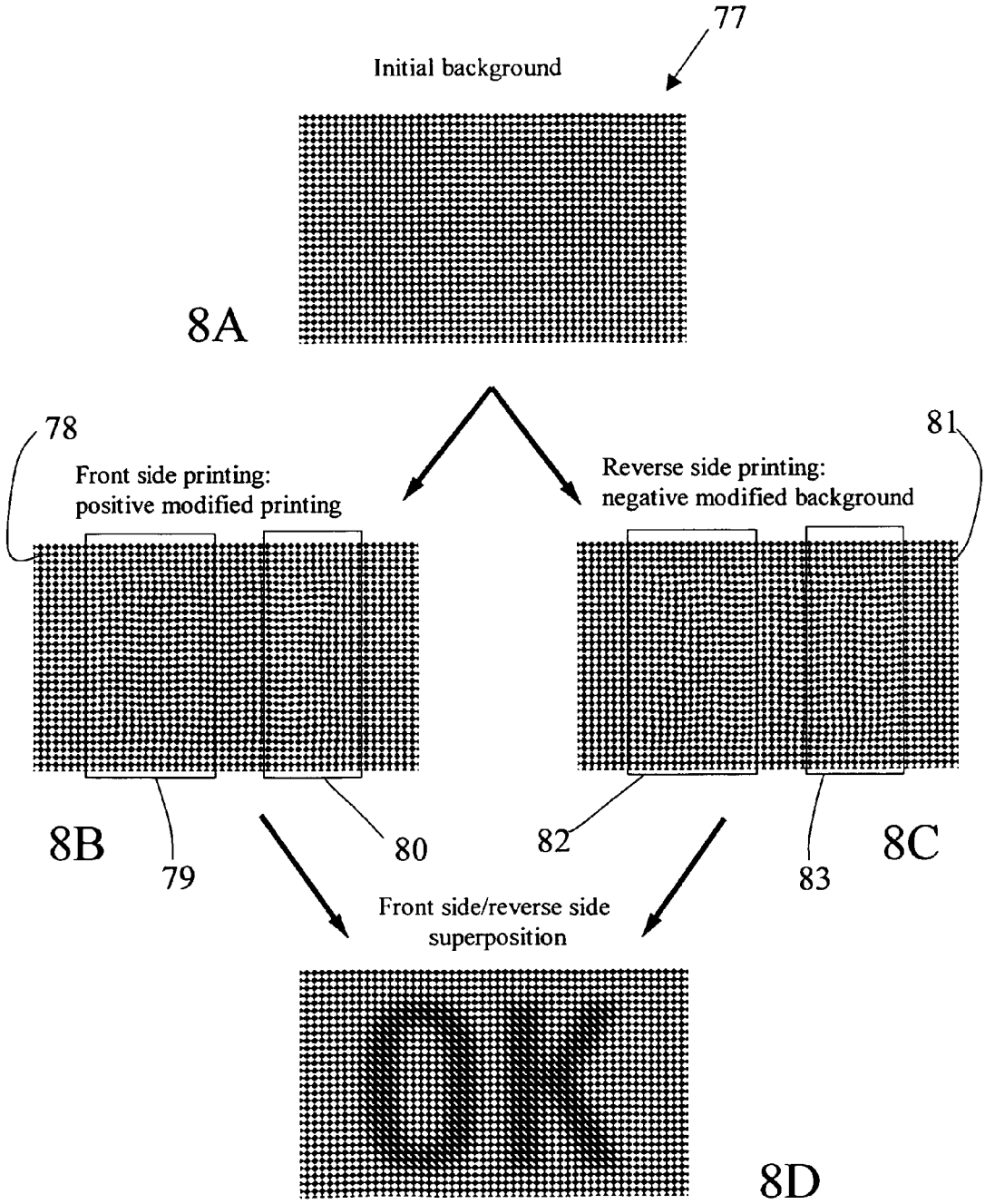
77
Initial background
8A
78
Front side printing:
positive modified printing
81
Reverse side printing:
negative modified background
8B
79
80
82
83
8C
Front side/reverse side
superposition
8D

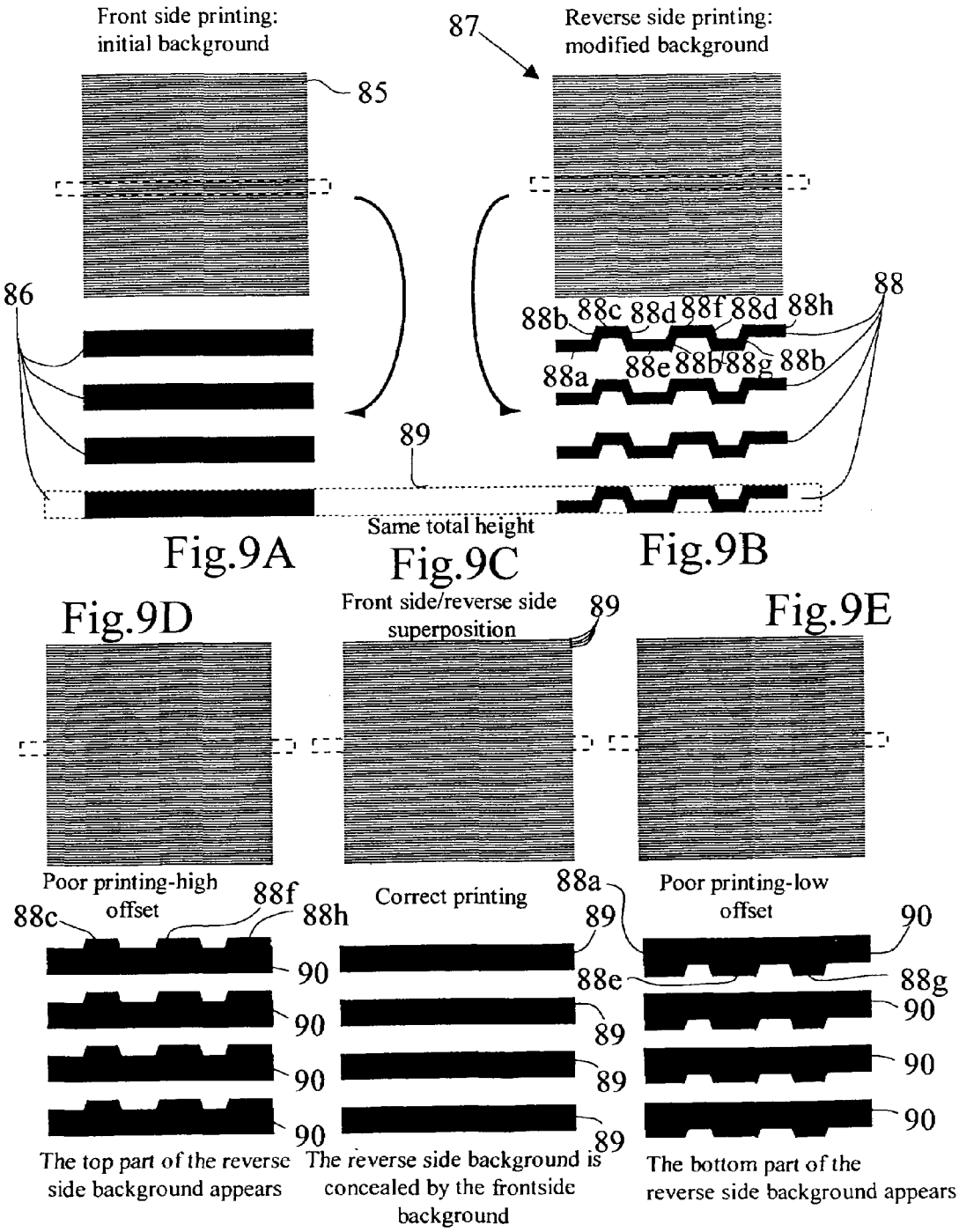
Front side printing:
initial background
85
86
Fig.9A
87
Reverse side printing:
modified background
88
88b
88c
88d
88f
88d
88h
88a
88e
88b
88g
88b
89
Same total height
Fig.9B
Fig.9C
Fig.9D
Front side/reverse side
superposition
89
Fig.9E
Poor printing-high
offset
88c
88f
88h
90
90
90
90
The top part of the reverse
side background appears
Correct printing
89
89
89
89
The reverse side background is
concealed by the frontside
background
Poor printing-low
offset
88a
90
88e
88g
90
90
90
The bottom part of the
reverse side background appears

CONTROL ELEMENT FOR PRINTED MATTERS

BACKGROUND OF THE INVENTION

The present invention relates to a control element for a printed article, in particular for securities or the like, which has, printed on a first side of said article, a first drawing comprising at least a first screen.

Such control elements are known in the prior art and are principally used to prevent the counterfeiting of securities, in particular the reproduction of banknotes. To make this counterfeiting, whether by photo-copying or by the use of a scanner coupled to a color printer, difficult or even impossible, control elements, usually called security elements, have begun to be incorporated into printed securities in addition to the special means already employed, such as for example watermarks in the paper.

This is because the technical advances made in photocopiers and scanners have been such that very effective equipment is now easily accessible to anyone. Thus the security elements themselves have had to be increased and improved as a consequence.

PRIOR ART

Various techniques have been developed to produce security elements for securities. As an example, one technique is that referred to as the latent color image technique. The idea behind this technique is to print a particular image on the security in such a way that this image is invisible to the naked eye. This may be achieved by playing with the color combinations and contrasts. When the security bearing this latent color image is photocopied or scanned, the latent color image becomes visible to the naked eye so that it is very easy to detect a counterfeit. As an example, publication U.S. Pat. No. 6,050,606, the content of which is incorporated in the present application by reference, discloses this principle of latent color images.

In European patent application EP 0 509 916, the content of which is incorporated by reference, a fiduciary document is described, said document having a printed graphical image and two superposed security markings, each being produced in the form of a watermark grid, the first of which has the form of a periodic watermark grid and the second results from cutting the printed graphical image into parallel strips arranged and coded in a binary coding, symmetrically with respect to an axis of symmetry of the document, the wave of the watermark grid extending in a common direction not perpendicular to the direction of the cut strips of the printed graphical image, and the superposition of these two markings having the effect of affecting the individual reading of said markings.

Finally, publication U.S. Pat. No. 5,772,249, the content of which is incorporated in the present application by reference, discloses a generation method and a security drawing composed of multiple lines. According to the principle explained in that patent application, the spacing between the lines is modulated and at the same time the width of said lines is modified, while maintaining a constant ratio between the width of the lines and the spacing between the lines so that the visual appearance (to the naked eye) does not seem to be altered. This technique is advantageous to the extent that the distribution of the lines may be parameterized according to the photocopiers and scanners against which it is desired to be protected.

SUMMARY OF THE INVENTION

The object of the present invention is to improve the known control elements so as to make counterfeiting more difficult.

More particularly, the aim of the invention is to propose a control element which is relatively simple to produce and by means of which it is easy to carry out a check of a printed article.

The control element according to the invention is defined by the features presented in the independent claim 1.

The dependent claims 2 to 7 define particular embodiments of the invention.

The dependent claims 8 and 9 respectively define securities and a sheet which includes at least one control element according to the invention.

A drawing according to the invention is particularly useful in the field of recto-verso printing, when the register between the printing on the front side and the printing on the reverse side is very important.

A major advantage of the element according to the present invention is that it can be used either to prevent counterfeiting or else to check the printing quality during printing of the printed article, in particular the recto-verso register of the printing.

BRIEF DESCRIPTION OF THE DRAWINGS

The invention will be more clearly understood from the description of several different embodiments thereof and from the figures which relate thereto, in which:

FIGS. 1A to 1D show a first embodiment of part of a drawing according to the invention, enlarged;

FIGS. 2A to 2D show a first variant of the first embodiment of FIGS. 1A to 1D;

FIGS. 3A to 3D show a second variant of the first embodiment of FIGS. 1A to 1D;

FIGS. 4A to 4D show a more general view of the embodiment of FIGS. 2A to 2D;

FIGS. 5A to 5D show a second embodiment of a drawing according to the invention, with concentric lines;

FIGS. 6A to 6D show a third embodiment of a drawing according to the invention, with wavy lines;

FIGS. 7A to 7D show a fourth embodiment of a drawing according to the invention, with inclined lines combined with a relief effect;

FIGS. 8A to 8D show a fifth embodiment of a drawing according to the invention, with a screen.

FIGS. 9A to 9E show a sixth embodiment of a drawing according to the invention, that can be used to adjust the front side/reverse side register of the printing;

DESCRIPTION OF THE PREFERRED EMBODIMENT(S)

Figure 10:
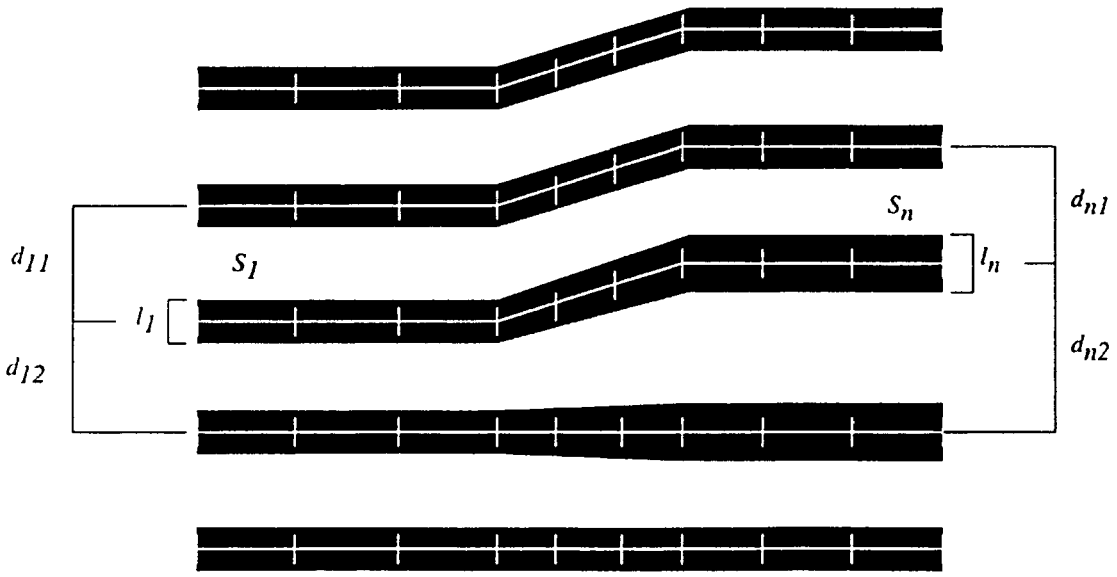
FIG. 10 shows another embodiment of a drawing according to the invention.

The first embodiment of a drawing according to the invention is described with reference to FIGS. 1A to 1D. In FIG. 1A, an initial background 1 is shown, this background comprising a set of parallel lines 2, and is printed on both sides of the printed article in register, that is to say the lines 2 face one another exactly. To produce the drawing according to the invention, the form of the lines 2 is modified during printing, at least on one of the sides of the printed article, by displacing sectors of said lines. This modification is shown in FIG. 1B, in which the lines that are not modified are still labeled by the number 2 and the modified lines are labeled 3 to 11 in succession.

Thus, the line labeled by the number 3 has several successive sectors labeled 3*a* to 3*g* which are offset in the manner shown in FIG. 1B. Likewise, the lines 4 to 11 also comprise successive sectors offset appropriately. As indicated, this background may be printed on the front side or the reverse side of the printed article. FIG. 1C shows a background 1 which is identical to the initial background of FIG. 1A. This background 1 is intended to be printed on the other side of the printed article with respect to the modified background of FIG. 1B, but in perfect register with said modified background. The result of this perfect register is that the lines or straight parts of lines are coincident when the printed article is viewed in transmitted light, whereas the successive offset sectors 3*a* to 3*g* and those of lines 4 to 11 become visible in transmitted light between said lines which are coincident. This has the result of forming a particular image, which is shown in FIG. 1D, visible only in transmitted light. If the sectors chosen to be offset are offset so as to form a particular predetermined image, it is then very easy to check if this predetermined image is visible in transmitted light and thus check both the authenticity of the printed article and the front side/reverse side register of the printing.

Thus, in the case of FIG. 1D, the superposition of the two lines labeled 2 in FIGS. 1B and 1C results in the lines labeled 2 in FIG. 1D, whereas the superposition of the line 3 and the sectors 3*a* to 3*g* of FIG. 1B with the corresponding line 2 of FIG. 1C results in the line 12 of FIG. 1D, with the thicker parts 12*a* and 12*b*.

Similarly, superposition of the lines 4 to 11 and of their offset sectors on the corresponding lines 2 of FIG. 1C results in the lines 13 to 19 of FIG. 1D with their respective thicker parts 14*a* and 14*b*, 15*a*, 16*a*, 17*a*, 18*a*, and 18*b*, 19*a* and 19*b*, 20*a* and 20*b*.

It is important to note that the drawing of the lines in FIGS. 1A to 1D and of the offset sectors is shown in an exaggerated manner in order to allow the present invention to be clearly understood. In fact, such lines in reality have a thickness varying between 10 $\mu$m and 500 $\mu$m and the gaps between the lines have a width lying approximately between one half and twice the width of a line, that is to say between 5 $\mu$m and 1000 $\mu$m. The aim is to produce such a drawing whose offset sectors are invisible to the naked eye and are recognized neither by photocopiers nor by scanners, so that they are not printed on a counterfeit of the printed article. Thus, a check in transmitted light allows the presence or absence of an element according to the invention to be immediately detected, and the front side/reverse side register may itself also be checked, as only perfect register will form the desired element.

In addition, in the example shown in FIG. 1D, the line sectors have been offset so as to form the letter "K". Of course, this is merely an example and other letters, compositions of letters or drawings are possible, the desired result being to vary the color density in transmitted light so as to form a visible symbol if front side/reverse side register is not correct.

In addition, this method is not limited to an upward offset, as indicated above, and it is also possible to use a downward offset or, if the lines of the background are turned through 90°, an offset to the right or the left on the front side or the reverse side.

In the first variant of the first embodiment, as shown in FIGS. 2A to 2D, the lines of the front side background and those of the reverse side background have been modified. Starting from the initial background 1 of FIG. 2A with parallel lines 2, on one of the sides, for example the front side, successive line sectors have been displaced as shown in FIG. 2B; thus, the line 21 includes successive sectors 21*a* to 21*g* and the other lines 22 to 29 each also include offset sectors as shown in this FIG. 2B.

In this first variant, the lines of the background on the other side of the printed article have also been modified, as shown in FIG. 2C which would be the reverse side if FIG. 2B is the front side. However, in this variant, the line sectors are modified in an inverse manner between the front side and the reverse side. Assuming that FIG. 2B shows the front side, the line sectors (for example 21*a* to 21*g*) are upwardly offset in the figure, whereas in FIG. 2C which would be the reverse side according to the initial assumption, the line sectors (for example 31*a* to 31*g*) are downwardly offset in FIG. 2C.

The result, in transmitted light, of the superposition of FIGS. 2B and 2C is shown schematically in FIG. 2D: again, if the register is correct, a predetermined symbol which depends on the offsets made to the lines is formed, in this example the letter "K", by the superposition of the lines and of the offset line sectors. Thus, in this variant, the superposition of the lines labeled 2 in FIGS. 2B and 2C gives the lines 2 of FIG. 2D and, for example, the superposition of the line 21 with the sectors 21*a* to 21*g* of FIG. 2B with the line 30 and the sectors 30*a* to 30*g* of FIG. 2C results in the line 39 and the widened sectors 39*a* and 39*b* of FIG. 2D when the register is correct. Similarly, the superposition of the lines 22 to 29 of FIG. 2B with the lines 31 to 38 of FIG. 2C results, in transmitted light, in the lines 40 to 47 of FIG. 2D when the register is correct with the widened sectors shown in the figure.

The particular advantage of this variant is that, as the two backgrounds are modified in an inverted manner, the offsets may be less than when a single background is modified since the front side/reverse side offsets add together: it is sufficient to compare FIGS. 1B and 2B to appreciate this point. It follows that if the offsets on each background are smaller, they are more difficult to perceive with the naked eye, or to reproduce by photocopying or by means of a scanner when considering only one—front side or reverse side—background, but the effect in transmitted light is not lessened since the offsets add together in transmitted light and remain just as visible.

Of course, this variant is not limited to a downward or upward offset as indicated above, but it is also possible to use an offset to the right or the left in the case of the front side and/or reverse side if the lines of the background are turned through 90° with respect to FIGS. 2A to 2D.

A second variant of the first embodiment is described with reference to FIGS. 3A to 3D. This variant is similar to that shown in FIGS. 2A to 2D as regards the line sectors which are offset (see FIGS. 3B and 3C). The main difference lies in the superposed recto-verso printing. In the variant in FIGS. 2A to 2D, exact superposition of the lines of the front side background with the lines of the reverse side background was sought in order to make the offset line sectors (21*a* to 21*g* or 30*a* to 30*g*) stand out between said lines. In the variant of FIGS. 3A to 3D on the other hand, when recto-verso printing it is sought to print lines not on top of one another but to offset them with respect to one another in an alternating manner so that each line of the front side lies between two neighboring lines of the reverse side. In this case, an offset is desired in order to create empty spaces which correspond to the offset of the line sectors, so that the control element is formed by the absence of printing rather than the presence of offset sectors. For example, referring to FIGS. 3B and 3C, if the lines 2 and 48 are printed on the front side, the reverse side will include the line 57 which will be placed between said lines 2 and 48 of the front side, and so on for the successive lines 49 to 2 of FIG. 3B between which will be successively printed, on the other side, the lines 58 to 66 of FIG. 3C. The result in transmitted light is then shown in FIG. 3D, in which it may be seen, on the one hand, that the frequency of the lines has increased and, on the other hand, the offset of the line sectors has created holes, for example 67 and 68, which form a predetermined image, in this case the letter "K". The register of the printing can therefore be easily checked in transmitted light.

FIGS. 4A to 4D show a more general view of the control drawing according to the invention as an example and allows a better appreciation of the visual effect created by an element according to the invention. These FIGS. 4A to 4D are based on the embodiment shown in FIGS. 2A to 2D, in which the front side background and the reverse side background include offset line sectors. The initial background 1 of FIG. 4A includes a set of mutually parallel lines 2. In FIG. 4B, the first four lines (labeled 2) starting from the top have not been modified and then, starting from the fifth line, successive line sectors (labeled 21', 22' etc.) begin to be offset as shown in FIG. 2B. Similarly in FIG. 4C, the first four lines 2 have not been modified and then, starting from the fifth line (labeled 31'), there are sectors offset in a similar manner to that shown in FIG. 2C. The lines of FIGS. 4B and 4C are therefore printed in register on the front side and the reverse side of the article respectively and if the front side/reverse side register is correct, FIG. 4D, which corresponds to FIG. 2D, is thus obtained in transmitted light.

A second embodiment of the invention will now be described with reference to FIGS. 5A to 5D. In this embodiment, the background 67 comprises concentric circles as shown in FIG. 5A. In a manner similar to the embodiments described above and using the same principle, concentric line sectors are suitably offset in the framed regions 68, 69 of FIGS. 5B and 5C. Thus, as in the previous embodiments, if the front side/reverse side register is correct, these offsets will form a predetermined image which will become visible in transmitted light, as shown schematically in FIG. 5D. Again, in this case the symbol is the letter "K".

Again according to the same principle, FIGS. 6A to 6D show a third embodiment in which the background 70 is formed by wavy lines. As in the embodiments described above, line sectors are suitably offset in order to form a symbol or a predetermined image. Line sectors may be offset either on one of the two sides of the printing (as in the embodiment in FIGS. 1B and 1C) or on both sides (as in the embodiment of FIGS. 2B and 2C) in order to create the desired image in transmitted light. In the example of FIGS. 6A to 6D, the front side background (FIG. 6B) was modified in the region 71 and the reverse side background (FIG. 6C) was modified in the region 72, and the superposition in transmitted light, when the register is correct, has the result shown in FIG. 6D in which the letter "K" appears in transmitted light.

FIGS. 7A–7D show a fourth embodiment in which clearly visible modifications of the lines of the background have been combined with offsets according to the principle of the invention. In this embodiment, as an example, the initial background 73 is based on inclined parallel lines as shown in FIG. 7A.

On the front side (FIG. 7B, background 74), clearly visible offsets of said lines have been produced so as to form a predetermined symbol 75, in the present case the number "200". At the same time, the principle of the invention is applied to the lines and, as described previously, for example as in FIG. 2B, are slightly offset, sufficient for these offsets not to be visible when considering the front side alone. The reverse side is then treated in a similar way, as shown in FIG. 7C. In this reverse side background, labeled 76, the lines have been visibly modified in order to form the successive letters "DLRG" on the background itself. Simultaneously, the lines of the background have been altered as described above (for example as in FIG. 2C) slightly, sufficient to be invisible but so as to form a given symbol. The result in transmitted light is shown schematically in FIG. 7D in which may be seen, all at the same time, the number "200", the letters "DLRG" and the control drawing which is, in this case, the letter "K", this letter appearing if the front side/reverse side register is correct.

One of the advantages of this embodiment is the fact that, as images, numbers or letters are formed in a clearly visible manner on the background, whether this be on the front side background 74, the reverse side background 76 or on both at the same time, and the alterations to the lines intended to form the security element are even more difficult to perceive if only one of the backgrounds, 74 or 76, is considered and not in transmitted light. On the other hand, in transmitted light, the effect according to the invention is preserved and the check is just as possible, as demonstrated in FIG. 7D.

Another embodiment using the principle of the invention is shown in FIGS. 8A to 8D. This embodiment uses not lines to form the background but is composed of a screen (background 77 of FIG. 8A). In the same way as in the other embodiments, the screen is distorted in a predetermined manner in order to form a given symbol. In the case of the embodiment shown, the screen 78 on the front side (FIG. 8B) has been distorted in the regions 79 and 80 and the screen 81 on the reverse side (FIG. 8C) has been distorted in the regions 82 and 83. Thus, once the printing has been carried out, if the register is correct, the respective distortions in the regions of the front side and reverse side screens form a predefined symbol which becomes visible in transmitted light. In the present case, the symbol that has been formed according to this principle is shown schematically in FIG. 8D by the letters "OK".

Another embodiment of the invention is described with reference to FIGS. 9A to 9E. In this embodiment, the drawing according to the invention is used to adjust the printing cylinders when setting up a recto-verso printing machine. This is because, it has been realized that, since the principle of the invention allows the front side/reverse side register on a printed article to be checked, this principle could be used both to detect counterfeits produced by means of photocopied or scanned articles and to adjust the front side/reverse side register of a printing machine by creating a particular symbol for this purpose. In the embodiment of FIGS. 9A to 9E, the control symbol described comprises two arrows of opposite direction. In this embodiment, the initial background of the front side 85 is composed of parallel successive lines 86 as shown in FIG. 9A. The initial background of the reverse side 87 is composed of parallel successive lines 88 as shown in FIG. 9B. Each line 88 furthermore includes segments 88*a* to 88*f* which are offset as shown in FIG. 9B. In the case of the lines 88 of FIG. 9B, what is important is that their height (for example the length of segments 88*b* and 88*d*) is equal to the width of the lines 86 of FIG. 9A. This is shown in FIGS. 9A and 9B by the portion 89 surrounded by dashed lines. This equal height is important and allows the principle of the invention to be used to adjust the front side/reverse side register of the printing. This is because if the register is correct the backgrounds 85 and 87 superpose, that is to say lines 86 and 88 superpose and that, in transmitted light, the front side background hides the reverse side background; in other words, the image which appears in transmitted light is that of FIG. 9C with lines 89 of constant thickness.

However, in the case of imperfect register and longitudinal offset of the printed articles on the front side and reverse side, the situation which arises is that illustrated in FIG. 9D or 9E, depending on the effective offset. For example, if the reverse side background is upwardly offset with respect to the front side background, that is to say the cylinder printing the reverse side is "ahead" of the cylinder printing the front side, then the segments 88*c*, 88*f* and 88*h* will be at least partially visible in transmitted light as illustrated in the bottom of FIG. 9D and the straight segments 90 will correspond to the superposition of the straight lines 86 and 88*a*, 88*e* and 88*g* of FIGS. 9A and 9B. In this case, and if the segments are arranged so as to form a given image, such as for example two arrows of opposite direction, if the offset is upward in the case of the reverse side, the upwardly directed arrow will become dark as illustrated in FIG. 9D (left-hand side of the figure) and that directed downward will become lighter (right-hand side of FIG. 9D). Conversely, if the offset is downward, then it is the segments 88*a*, 88*e* and 88*g* which will be visible in transmitted light, as illustrated at the bottom of FIG. 9E and the lines 90 of this figure will be the result of the superposition of the lines 86 (FIG. 9A) with the segments 88*c*, 88*f* and 88*h* (FIG. 9B). In this case, it is the downwardly directed arrow which becomes dark and that directed upward will become lighter, as shown in the upper part of FIG. 9E.

Such a control drawing thus allows the front side/reverse side register of the printing to be very easily checked, the fineness of the adjustment being determined by the thickness of the lines 86 and the offsets 88*a* to 88*g*. In addition, this control means may be used both for adjusting the longitudinal offset and the lateral offset. To do this, all that is required is to combine a drawing according to FIGS. 9A and 9B with an element which is identical but in which the lines are oriented perpendicular to those of FIGS. 9A and 9B.

FIG. 10 shows yet another embodiment of a drawing according to the invention. In this embodiment, the offset of the lines is masked in order to conceal even more from being seen with the naked eye. According to the example shown, each line is cut into segments $S_1$ to $S_n$. A segment $S_n$ is characterized by its line width $l_n$ and by distances $d_{n1}$ and $d_{n2}$ between this segment and the corresponding segment of the previous line and this segment and the corresponding segment of the next line. A reference ratio is defined by the first segment of a line: $r_1=l_1/(d_{11}+d_{12})/2$. This line width/average distance ratio is kept constant and equal to $r_1$ for all the line segments. Thus, for the segment $S_n$, we have $r_n=l_n(d_{n1}+d_{n2})/2=r_1$, hence $l_n=r_1(d_{n1}+d_{n2})/2$.

In addition, the length of the segments may vary along the lines, and in particular shorter segments are advantageous in the regions which are greatly changed and give better masking.

Figure 11:
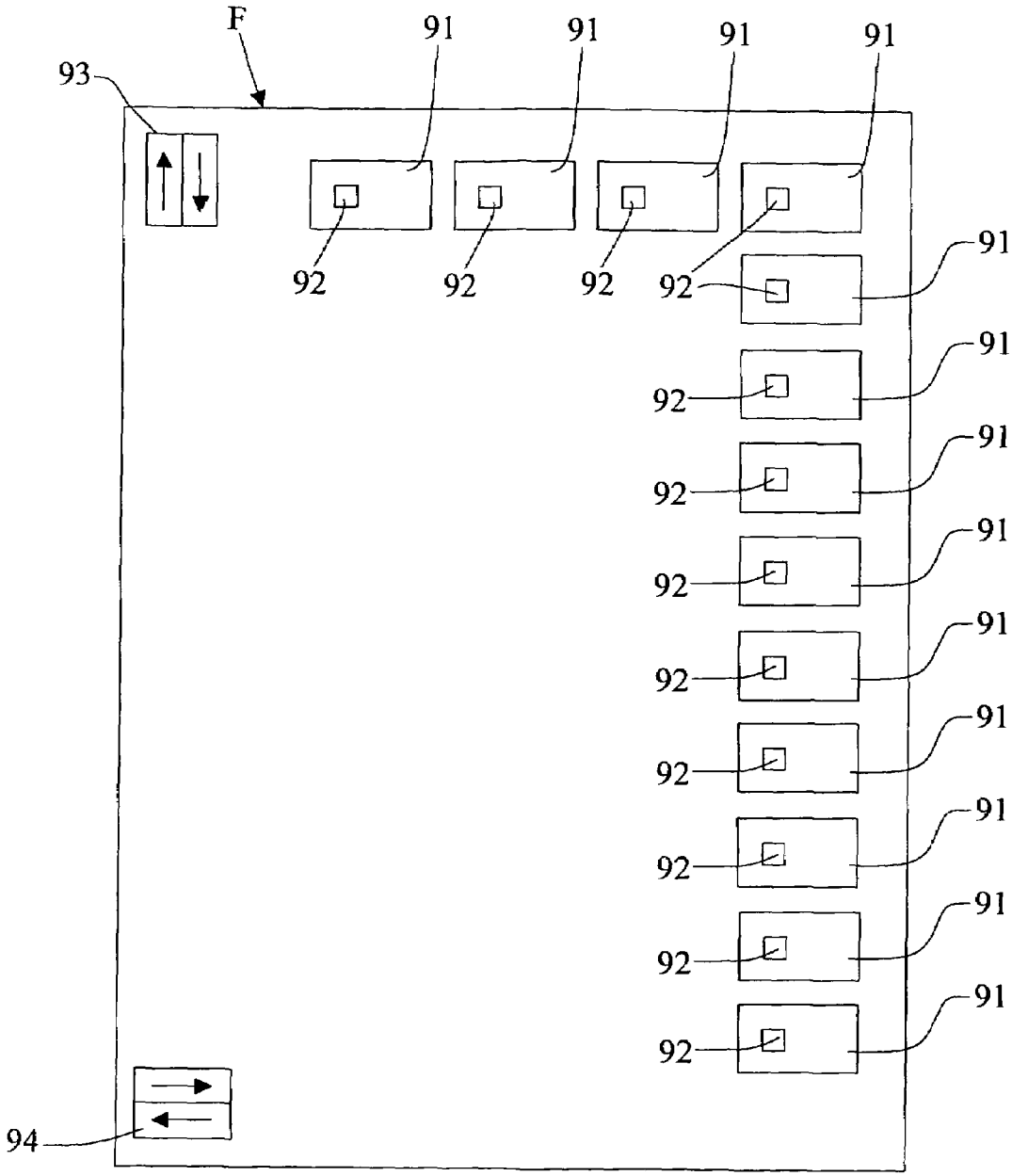
FIG. 11 finally shows, schematically, a sheet comprising printed articles, for example banknotes, each banknote including a control drawing according to the invention and the sheet itself also including a control drawing according to the invention.

FIG. 11 illustrates schematically how elements using the principle of the invention may be combined on a single sheet bearing printed articles, for example printed securities. This sheet F comprises a certain number of printed articles 91 arranged as a matrix of rows and columns beside one another. Each of these printed articles 91 comprises at least one control element 92 using the principle described with reference to FIGS. 1A to 8D. In this case, the element 92 is used as a security element preventing subsequent falsification of the printed articles, for example by photocopying or scanning. In addition, two control elements 93 and 94 according to the first embodiment of the invention described with reference to FIGS. 9A to 9E are used to adjust the front side/reverse side register of the printing. These control elements 93 and 94 are located, as an example, along the edges of the sheet F and aligned along two perpendicular axes, thereby making it possible to adjust the front side/reverse side register of the printing in the two perpendicular directions in the manner explained above.

The invention is not limited to the embodiments described and variations are possible, especially by the use of equivalent means. Moreover, these control means may be used for all types of securities, namely banknotes, fiduciary papers, etc.

A control element according to the invention may be used not only to prevent counterfeiting but also to check the quality of the printing. If, for example banknotes are printed, it is very easy to check the printing quality of individual banknotes by checking that the control element is present. Known simple means would in fact be used to see if the control symbol appears. For example, by illuminating the banknotes from their reverse side, a camera placed on the front side may identify the presence or absence of the control symbol perfectly.

In addition, the printing medium may be varied: it is possible to use paper or another medium such as, for example, a plastic medium, made of a polymer, a polyester or equivalent. The more transparent the printing medium, the more pronounced and visible the effect in transmitted light according to the invention. Thus, prior preparation of the printing medium may also be imagined in the printing region having the control element according to the invention, for example a varnish or a watermark effect.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A sheet comprising successive printed articles arranged in matrix form, in rows and columns, wherein said sheet comprises at least one control element having a first drawing printed on a first side of said sheet, comprising at least a first set of geometrical shapes, which control element comprises a second drawing printed on a second side of said sheet, the second drawing being printed so as to face the first drawing and be in register with the latter, said second drawing comprising at least a second set of geometrical shapes corresponding to the first set of geometrical shapes, and wherein at least one of said geometrical sets includes sectors which are substantially invisible to the naked eye and which are offset so that, when a front side/reverse side register is correct, the control element has regions of variable density which are visible in transmitted light and are created by said offset sectors.

2. The sheet of claim 1, wherein said offset sectors form a predetermined image.

3. The sheet of claim 1, wherein said sets of geometrical shapes are formed by parallel lines.

4. The sheet of claim 1, wherein said sets of geometrical shapes are formed by concentric lines.

5. The sheet of claim 1, wherein said sets of geometrical shapes are formed by wavy lines.

6. The sheet of claim 1, wherein said sets of geometrical shapes are formed by a regular screen.

7. The sheet of claim 1, wherein the two sets of geometrical shapes include offset sectors.

* * * * *